United States Patent [19]

Bourquin et al.

[11] Patent Number: 4,853,908

[45] Date of Patent: Aug. 1, 1989

[54] TIMING MECHANISM WITH TIDE INDICATOR

[76] Inventors: Francis Bourquin, P.O. Box 852, 2501 Bienne, Switzerland; Ira Krieger, 407 Lincoln Rd., Suite 10-B, Miami Beach, Fla. 33139

[21] Appl. No.: 230,369

[22] Filed: Aug. 10, 1988

[30] Foreign Application Priority Data

Mar. 31, 1988 [CH] Switzerland ..... 1225/88

[51] Int. Cl.[4] ..... G04B 19/26

[52] U.S. Cl. ..... 368/19; 368/15

[58] Field of Search ..... 368/16, 18, 19, 15

[56] References Cited

U.S. PATENT DOCUMENTS 3,524,313 8/1970 Wood ..... 368/19

3,703,804 11/1972 Appelberg ..... 368/19

*Primary Examiner*—Bernard Roskoski

*Attorney, Agent, or Firm*—John Cyril Malloy

[57] ABSTRACT

A timing mechanism having a tide indicator including a window in its dial. Under the dial is placed a flat annular wheel fitted with two signs or indicator markings which appear in turn in the window. Around the edge of the window are additional indicator markings which enable one to estimate the time until the next tide. High tide is shown when one of the appropriate signs is situated at the top of the window, and low tide when it is at the left or right thereof. The annular wheel is guided by a semi-circular plate around which it slides. It is driven by a toothed wheel fixed on a motion work of the watch movement. The toothed wheel activates a gearing fitted around the internal circumferentce of the annular wheel.

8 Claims, 2 Drawing Sheets

TIMING MECHANISM WITH TIDE INDICATOR

BACKGROUND OF THE INVENTION

Field of the Invention

Various solutions have been put forward for uniting horological parts, which display the solar time, with indicators for the times of the high and low tides. The majority of the solutions which have been put forward contain a hand which turns on a secondary dial and which indicates the time at which the high tide and/or low tide must take place. This is the case, for example, of U.S. Pat. Nos. 2,677,928, 3,524,313, 3,708,971 and 4,014,163. Another solution includes the placing a hand in the center, like the other hands, and controlling it through a gear whose reduction causes this hand to make one turn during the time corresponding to the period between two high tides. This is the case, for example, of U.S. Pat. No. 4,014,163.

The inconvenience of the first solution lies in the fact that indication of the time at which the particular tide must take place is not very evident and the reader must refer to the solar time in order to mentally calculate the time remaining until the next particular tide. In the case where a small secondary dial is used, the aesthetic appearance is also somewhat debatable. As for the second solution, which is undoubtedly clearer to read, it nonetheless has the disadvantage that it could possibly lead to confusion between, on the one hand, the hands indicating the hours, minutes and seconds, and on the other, the hand indicating the tides.

The present invention aims to providing a timing mechanism with a clearly readable tide indicator, the reading of which cannot be confused with that of the hours, minutes and seconds, and which immediately and visually indicates the time left to run until the next tide. Moreover, the present invention aims at providing a mechanism which gives the phases of the moon at the same time as the cycles of the tides.

BRIEF DESCRIPTION OF THE DRAWINGS

For a fuller understanding of the nature of the present invention, reference is had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
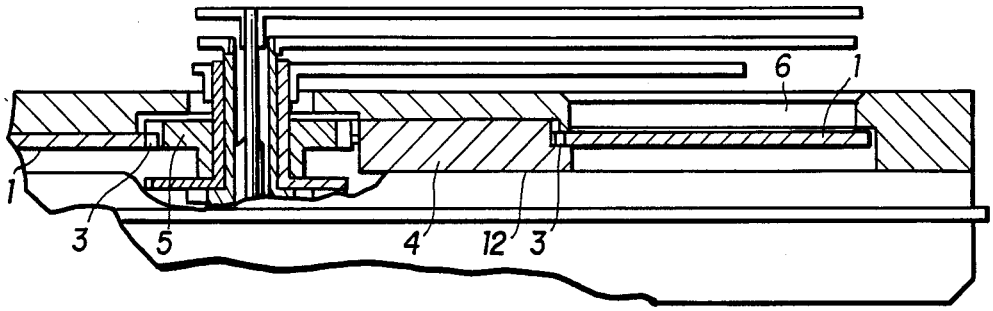
FIG. 1 is a sectional view in partial cut-away of one embodiment of the present invention.
Figure 2:
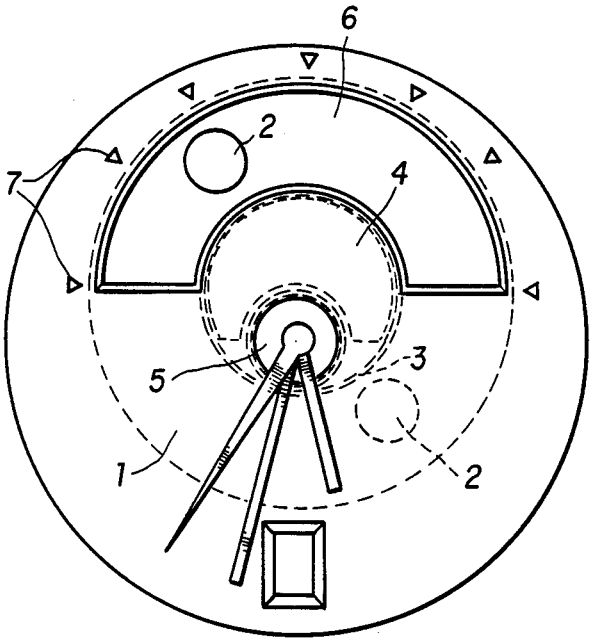
FIG. 2 is a front plan view of the embodiment of FIG. 1.

In one preferred embodiment of the subject invention as shown in the mechanism represented in FIGS. 1–4 is a watch fitted with a classic movement, for example, mechanical or electrical. As shown in FIGS. 1 and 2, above, the movement beneath the dial, a plate in the shape of a semicircle 4 has been added. In the type of execution represented herein, the plate 4 is secured onto the movement. The plate 4 is eccentric in relation to the movement, i.e.; the center of the movement does not coincide with the center of the plate. The edge of the plate contains a recess into which a toothed wheel 5 is fitted, and this is concentric to a pinion post which carries the hands. The toothed wheel 5 is fixed to the motion works.

Around the plate 4 is placed a flat annular wheel 1. This annular wheel 1 contains teeth 3 on the internal circumference. The teeth 3 mesh with the toothed wheel 5. The toothed wheel 5 is therefore in effect tangent to the circumference defined by the plate 4. The gear ratio between the toothed wheel 5 and the teeth on the annular wheel 1 is such that the number of turns made by the annular wheel 1 correspond to the cycle of the tides.

In the type of execution represented here, the annular wheel 1 makes one turn for one cycle of two high tides and two low tides in twenty-four hours and fifty minutes.

The annular wheel 1 is held in position by the plate 4, which functions as a fixed axle, around which the annular wheel 5 slides in its rotating movement.

Two signs or indicator markings 2 are shown on the annular wheel 1, which are placed opposite one another along the diameter of the annular wheel 1. These signs 2 are circular in shape.

The dial contains a semicircular shape window 6 which allows each of the signs 2 to be visible therethrough during half of their circular course as the annular wheel rotates.

The dial is fitted with indexes 7 which are situated around the outer peripheral edge of the window 6 and which correspond to specific hours. The annular wheel 1 turns, activated by the toothed wheel 5 and in turn displays one of the signs 2 in the window 6.

The passage of one of the signs 2 at the top of the window 6 corresponds to the high tide. The low tide position is indicated by the presence of both of the signs 2 on opposite ends of the window 6, at the time when they are half hidden. In this position, one the signs 2 on the right has aleady half disappeared, while the other sign 2 on the left is half appearing. Between the two low tide points, one of the two signs 2 passes successively in front of each index 7. The distance between each index corresponds, in the drawings, to a period of two hours. It goes without saying that another period of time could be indicated. The person who looks at the dial therefore, immediately sees from the position of the signs 2 relative to the wndow 6 and the indexes 7, if the tide is rising or ebbing, and how much time remains until the next high or low tide.

Figure 3:
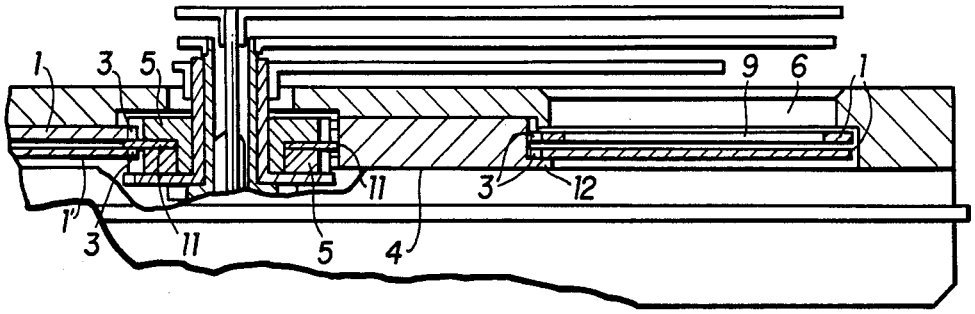
FIG. 3 is a sectional view in partial cut-away of another embodiment of the present invention.
Figure 4:
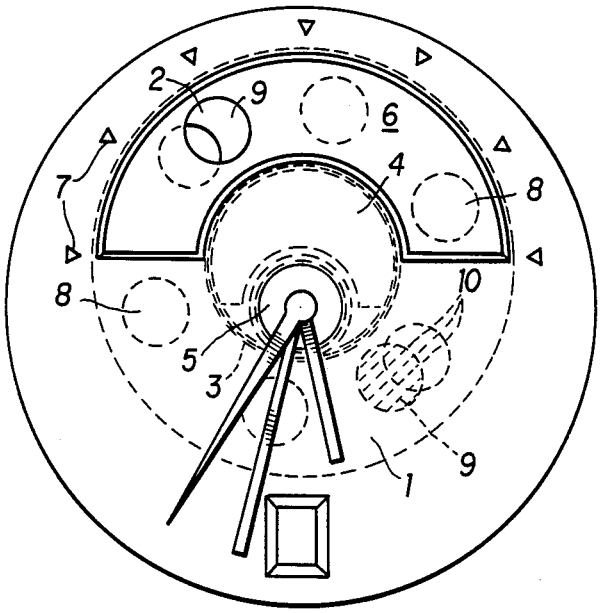
FIG. 4 is a front plan view of the embodiment of FIG. 3.

In another embodiment shown in FIGS. 3 and 4, the mechanism is fitted with two overlying or superimposed annular wheels 1 and 1', each being driven by a different toothed wheel 5 and 5' respectively. These two toothed wheels 5 and 5' are also mounted on the motion work. The upper toothed wheel 5 is driven by the motion work, while the lower toothed wheel 5' is only driven by the motion work through friction.

The gear ratios between each toothed wheel 5 and 5' and the respective teeth 3 and 3' of the annular wheels 1 and 1' which it controls are different, so that the lower annular wheel 1' turns slower than the upper annular wheel 1.

The upper annular wheel 1 contains two circular openings 9 placed opposite each other along the diameter thereof, as in the embodiment of FIG. 1 and 2. The lower annular wheel 1' contains several colored circles 8 which are equidistant from each other and from the center of the annular wheel. These circles are of the same diameter as the circular openings 9. In this embodiment, there are six circles 8. These six circles 8 appear successively through the circular opening 9. As the annular wheels 1 and 1' turn, one sees a circle 8 progressively appear in the opening 9 and at a certain point in time, this opening is completely filled, then the circle 8 continues to move, disappearing slowly, until it becomes hidden by the upper annular wheel 1. At that point, the circular opening 9 is empty. Immediately thereafter, the next circle 8 begins to appear, and the cycle begins again.

The part of the lower annular wheel 1' which appears in the circular opening 9 of the upper annular wheel 1 also has a circular shape; since the circle 8 covers a part of this visible surface, it is a circle bearing the outline of a crescent which appears (see FIG. 4).

In this embodiment, therefore, it is not only the time of the tide which is indicated, but also the phase of the moon. In fact, the gear ratios between the toothed wheels 5 and 5' and the respective annular wheels 1 and 1' are calculated so that the crescent configuration which appears on the circular sign 8 delineated by the superimposition of the two annular wheels 1 and 1', corresponds to the phase of the moon, that is, to the visible part of the moon on the day in question.

In the two embodiments represented, the sign 2 becomes visible at the top of the window 6 at each high tide. However, in the majority of places subject to tides, there are two high tides every twenty-four hours and fifty minutes, so that one time out of two, the moon is not visible. In other words, one time out of two the phase of the moon which appears on the sign 2 is not the moon visible at the place where the user of the mechanism is situated but rather, the phase of the moon visible at the antipode to that observer. To mark this difference, one of the two circular openings 9 is crossed with parallel bars 10, so that the user can distinguish the phase of the moon corresponding to the moon which is visible in his hemisphere and the phase of the moon visible at the antipode.

In order to visually separate the crescent of the moon from the background, both the surface of the upper annular wheel 1 and the circles 8 could be the same color, for example, dark blue or black. However, such uniform coloring is inconvenient in that on the days with no moon, the tide indicator will no longer be visible and will consequently be ineffective. It is therefore preferable that the surface of the upper annular wheel of the circles 8 be given a different coloring so that the sign 2 is always visible, even if the crescent of the moon is not.

The upper toothed wheel 5 follows the movement of the hour hand, be it in a clockwise or anticlockwise direction. The lower toothed wheel 5' is retained by a "click" when the hour wheel turns in the anticlockwise direction. That way, it is easy to correct the position of the sign 2 by putting it in the right place according to the tide of the place in question. Correcting the phase of the moon is done by turning the hour hand anticlockwise. The upper toothed wheel 5, therefore, is the only one that turns, and this enables the desired phase of the moon to be chosen.

In order to avoid too much friction between the two annular wheels 1 and 1', a washer 11 is placed between the two toothed wheels 5 and 5'. Since its diameter is greater than that of the two toothed wheels, the external edge of this washer 11 separates the two annular wheels 1 and 1'.

In order to guide the annular wheel (or wheels), the plate 4 contains a lower rim 12 on which one surface of the annular wheel rests; in the second embodiment, only the lower annular wheel rests on this rim. The annular wheel is held in place on the other side by the dial, which has been shaped for this purpose (in the second embodiment, only the upper annular wheel 1 can come into contact with the dial). It is seen in FIGS. 1 and 3 that the internal surface of the dial is not uniformly flat, but that hollows have been created so as to leave the necessary space free for the components, while at the same time maintaining a very slight distance between the upper surface of the annular wheel and the internal surface of the dial. Similarly, one hollow corresponds to the position occupied by the toothed wheel 5 and another hollow to the one occupied by the plate 4.

Now that the invention has been described,

What is claimed is:

1. A timing mechanism including a tide indicator and having a watch movement and an analog display for the solar hour, said mechanism comprising:

a. at least one flat, annular wheel including at least one indicator sign on an exposed surface thereof, b. a gear structure formed on an interior circumferential edge of said annular wheel and a semi-circular plate fixed to the watch movement and disposed within said annular wheel and including a diameter corresponding through that of said annular wheel, c. at least one gear wheel having gear teeth formed along an outer peripheral edge thereof and activated by the watch movement and disposed within said annular wheel in a space not occupied by said semi-circular plate, d. said gear structure of said annular plate disposed in meshing engagement with said gear teeth of said one gear wheel and said annular wheel rotatable thereby about said plate upon activation and rotation of said gear wheel, e. a dial face including an open window formed therein and disposed in overlying relation to said exposed surface of said annular plate and in aligned, exposed relation to said one indicator sign as it rotates with said annular plate relative to said window, f. an index means formed on the dial adjacent a periphery of said window for indicating time of travel of said one indicator sign, g. said gear wheel and said gear structure defining a gear ratio therebetween sufficient to define passage of said one indicator sign pasing relative to said window and said index means to indicate a time of both high tide and low tide at a given geographical location.

2. A mechanism as in claim 1 comprising said annular wheel being eccentrically mounted relative to a central axis of rotation of watch hands of the watch movement.

3. A mechanism as in claim 2 comprising said one gear wheel being coaxially mounted to the central axis of rotation of the watch hands and rotatably driven by the movement in correspondence with the rotation of an hour hand thereof.

4. A mechanism as in claim 1 comprising said open window having a substantially semi-circular configuration.

5. A mechanism as in claim 4 comprising two superimposed annular wheels including a lower annular wheel having a plurality of circles equally spaced from one another on an exposed surface thereof and from the center of said lower annular wheel, an upper annular wheel including two circular openings formed thereon and said openings including a diameter substantially equal to the diameter of the circles, said two openings being placed opposite each other along the diameter of said upper annular wheel; two superimposed gear wheels each disposed to operate one of the lower and upper annular wheels, a gear ration between each gear wheel and its corresponding annular wheel being different from a gear ratio between the other gear wheel and corresponding annular wheel and said two gear ratios being such that rotation of each of the two annular wheels are different; said circles progressively appearing and disappearing in said opening forming an indicator sign whose shape is that of a visible part of the moon on a particular day in question.

6. A mechanism as in claim 1 comprising said semi-circular plate including a lower rim on which said one annular wheel rests and slidingly rotates therearound, said annular wheel held in place on an opposite side of the dial relative to said semi-circular plate.

7. A mechanism as in claim 5 comprising said two annular wheels being separated from each other by a washer structure placed between said two gear wheels, said washer having a greater diameter than said two gear wheels.

8. A mechanism as in claim 1 wherein said index means comprises a plurality of index elements disposed in spaced relation to one another along an upper periphery of said window and further disposed along the length thereof so as to register a specific one of said index elements with said indicator sign so as to accurately indicate the time of high tide and the time of low tide at a given geographical location.

* * * * *